US005820045A

United States Patent [19]

Karra

[11] Patent Number: 5,820,045

[45] Date of Patent: Oct. 13, 1998

[54] CONICAL CRUSHER HAVING A SINGLE PIECE OUTER CRUSHING MEMBER

[75] Inventor: Vijia Kumar Karra, Franklin, Wis.

[73] Assignee: Nordberg Incorporated, Milwaukee, Wis.

[21] Appl. No.: 658,366

[22] Filed: Jun. 5, 1996

[51] Int. Cl.[6] ..... B02C 2/04

[52] U.S. Cl. ..... 241/207; 241/215; 241/293

[58] Field of Search ..... 241/207, 208, 241/214, 215, 216, 293

[56] References Cited

U.S. PATENT DOCUMENTS

| | | | |
|---|---|---|---|
| 3,582,008 | 6/1971 | Motz et al. | 241/207 X |
| 4,604,781 | 8/1986 | Rankin, III | 241/293 X |
| 4,895,311 | 1/1990 | Arakawa | 241/208 X |
| 5,516,053 | 5/1996 | Hannu | 241/207 |
| 5,570,850 | 11/1996 | Kay | 241/215 X |

FOREIGN PATENT DOCUMENTS

| | | | |
|---|---|---|---|
| 1 137 928 | 10/1962 | Germany | 241/207 |
| 461740 | 9/1975 | U.S.S.R. | 241/214 |
| 716586 | 2/1980 | U.S.S.R. | 241/207 |
| 1533755 | 1/1990 | U.S.S.R. | 241/215 |
| 1731270 | 5/1992 | U.S.S.R. | 241/207 |

*Primary Examiner*—John M. Husar
*Attorney, Agent, or Firm*—Foley & Lardner

[57] ABSTRACT

A conical crusher having a rigidly supported outer frusto-conically shaped crushing member and an inner conical crushing member supported on a wobble mechanism which is in turn supported by air bellows. The air pressure in the air bellows is regulated to adjust the spacing between the inner and outer crushing members, and therefore the particle size of the crushed material. The inner and outer crushing members are readily replaceable. The outer crushing member is a single piece bowl/bowl liner component.

20 Claims, 4 Drawing Sheets

COMP.

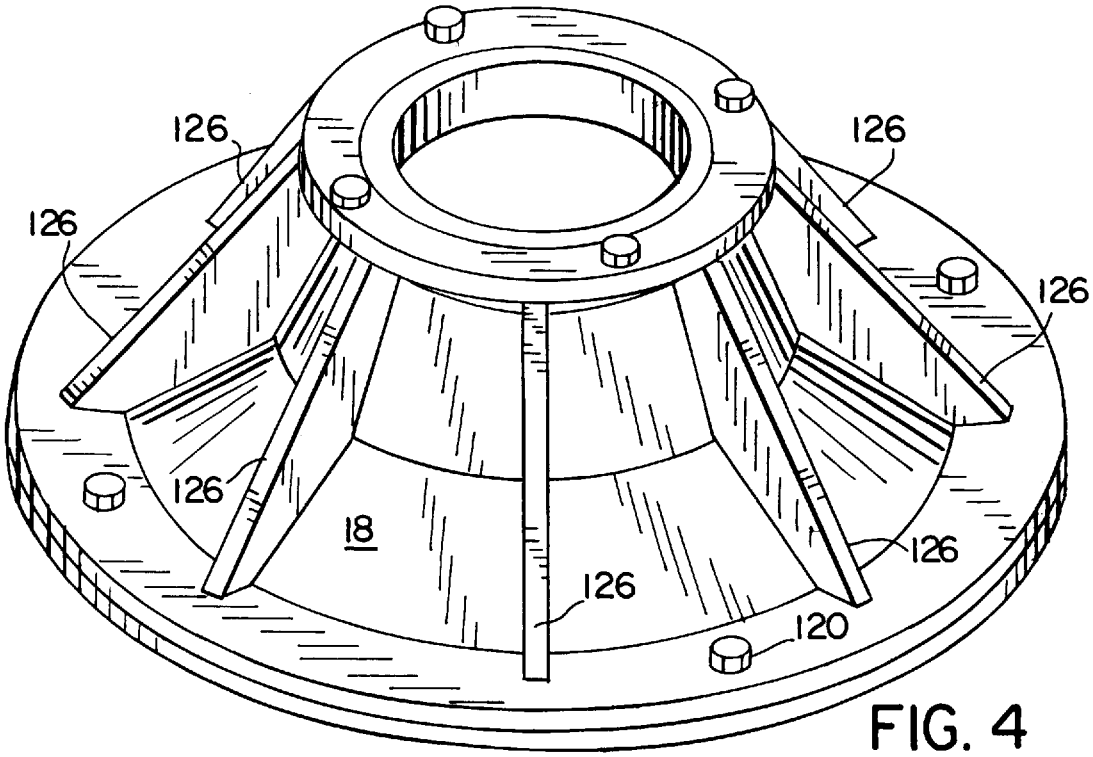
FIG. 4
FIG. 5
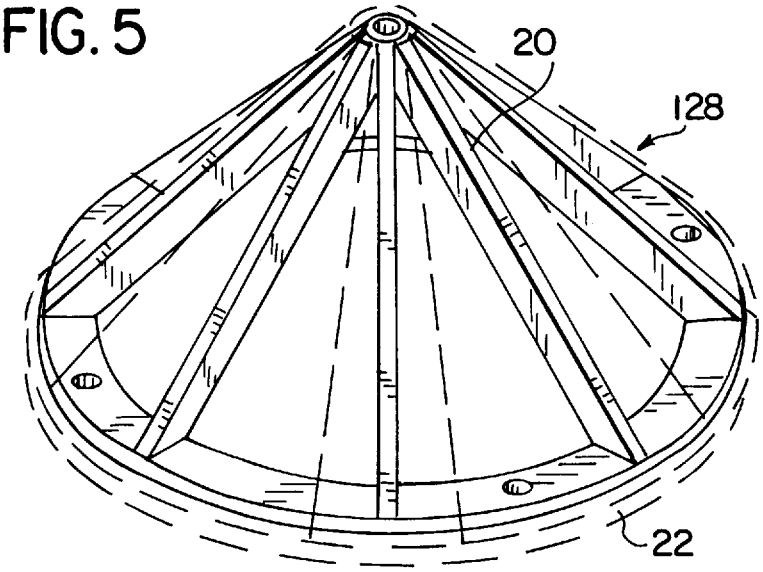

CONICAL CRUSHER HAVING A SINGLE PIECE OUTER CRUSHING MEMBER

CROSS REFERENCE TO RELATED APPLICATIONS

The present application is related to U.S. application Ser. No. 08/658,650 entitled "A Conical Crusher Having Fluid Bellow Support Assemblies," now pending and U.S. application Ser. No. 08/658,353, entitled "A Conical Crusher Having a Single Piece Inner Crushing Member," now pending both assigned to the Assignee of the present invention and invented by Karra.

FIELD OF THE INVENTION

The present invention generally relates to a conical crusher. More particularly, the present invention relates to a rock crusher of simplified construction and superior operational efficiency. The rock crusher can be used for size reduction of low strength, easy to crush materials such as rocks and minerals and for light duty shaping-type crushing operations.

BACKGROUND OF THE INVENTION

Conical crushers having head assemblies which are caused to gyrate by an eccentric mechanism, driven by various rotary power sources, are commonly available and have been the subject of numerous prior patents. A conical crusher typically has an annular shell and a central hub to which an annular ring is mounted for vertical movement. The crusher bowl and liner are mounted on the annular ring. The head assembly includes a liner which is mounted, for movement through a bearing mechanism, directly to a stationary shaft within the hub. Gyration of the head relative to the bowl assembly is provided by an eccentric mounted for movement about the stationary shaft. With respect to rotation about the shaft, the eccentric is dynamically balanced about its center of rotation by a counter weight. The bowl of the crusher is provided with an upper liner and the head member is provided with a replaceable mantle.

Alternatively, another type of conical crusher can include a shaft which is moved by a hydraulic piston arrangement attached to the bottom end of the shaft. The bowl liner can be fixed to a mechanical adjustment device. In both types of cone crushers, the gap between the bowl liner and crushing head can be manipulated to provide particular sized crushed product. Both of these types of rock crushers have proven most satisfactory in heavy-duty crushing operations, particularly when the coacting crushing surfaces, which are subject to wear, are provided with replaceable liners for extending the life of the crusher.

However, for certain crushing and shaping operations, a less robust crusher, of simpler and lighter weight construction and greater operational efficiency, is desirable. For instance, it is not necessary to use a heavy-duty crusher, such as set forth in the above-mentioned patents, for low strength, easy to crush rocks and minerals such as coal and non-metallic minerals, and for light duty shaping type crushing applications. Thus, there is a need for a rock crusher which does not utilize massive support structures. Further, there is an economic need for a light duty crusher which can be easily adjusted for crushing various sizes of crushed materials. There is further a need for a light duty crusher which only requires a one piece bowl/bowl liner or outer crushing member.

SUMMARY OF THE INVENTION

The present invention relates to a crusher mounted on a foundation. The crusher includes a main support member for securing to the foundation, a generally conically shaped, downwardly spreading, inner crushing member supported within the main support member, and a one piece, generally frustoconically shaped, downwardly spreading outer crushing member. The outer crushing member is supported on an annular rim of the main support member in a spaced relationship to the conically shaped inner crushing member such that material passing between the inner crushing member and the outer crushing member is crushed.

The present invention also relates to a single piece outer crushing member for use in a crusher including a feed hopper, a main support member, and a generally conically shaped downwardly spreading inner crushing member supported by the main support member. The main support member includes an outer rim and the inner crushing member is configured for gyrating with respect to the main support member. Material is fed through the feed hopper and is crushed between the outer crushing member and the inner crushing member. The single piece outer crushing member includes a generally frustoconically shaped, downwardly spreading, outer crushing wall, a first flange, and a second flange. The outer crushing wall has a top end and a bottom end. The first flange is integrally formed at the top end of the wall and the first flange is configured for engagement with the feed hopper. The second flange is integrally formed at the bottom end of the wall, and the second flange is configured for engagement with the outer rim of the main support member.

The present invention further relates to a crusher mounted on a foundation. The crusher includes a main support member secured to the foundation, a wobble mechanism, a conically shaped downwardly spreading inner crushing member, and a single piece frustoconically shaped outer crushing member. The main support member has at least one aperture and the wobble mechanism is disposed within the aperture. The inner crushing member is coupled to the wobble mechanism and supported by the main support member. The outer crushing member is supported on the main support member in a space relationship to the conically shaped inner crushing member. The outer crushing member has an inside surface and an outside surface. The outside surface is an exterior surface of the crusher.

The present invention still further relates to a conically shaped downwardly spreading inner crushing member which is supported upon a bottom plate which is secured to the top surface of the upper member of the wobble mechanism. A frustoconically shaped downwardly spreading outer crusher member is a single piece and is supported in a fixed position surrounding the inner crushing member. The wobble mechanism, and therefor the inner crushing member, is supported so as to be vertically adjustable with respect to the base of the crusher. By adjusting the vertical position of the inner crushing member, its position with respect to the outer crushing member is adjusted. In a preferred embodiment, the inner crushing member is adjustably supported on the base of the crusher by an air bellows assembly. By regulating the air pressure in the air bellows, the relative height of the inner crushing member with respect to the base of the crusher may be adjusted.

In one aspect of the present invention, a single piece bowl/bowl liner is provided which has an inner surface and an outer surface. The outer surface is part of the exterior of the crusher. The advantageous orientation of the crusher allows the crushing operation to be completed without need of a bowl or bowl liner configuration. The single piece outer crushing member is preferably generally conically shaped and may include several stepped or angled surfaces. The outer crushing member also serves as a mounting for a feed hopper which provides material. The outer crushing member also serves as part of the exterior housing of the crusher and is mounted directly to the main frame of the crusher.

BRIEF DESCRIPTION OF THE DRAWINGS

FIG. 4 is a perspective view of an alternative embodiment of the outer crushing member of the conical crusher shown in FIG. 1, which is provided with a support rib cage; and FIG. 5 is a perspective view of a support rib cage for the inner crushing member of the conical crusher shown in FIG. 1.

DETAILED DESCRIPTION OF THE PREFERRED EMBODIMENT

Figure 1:
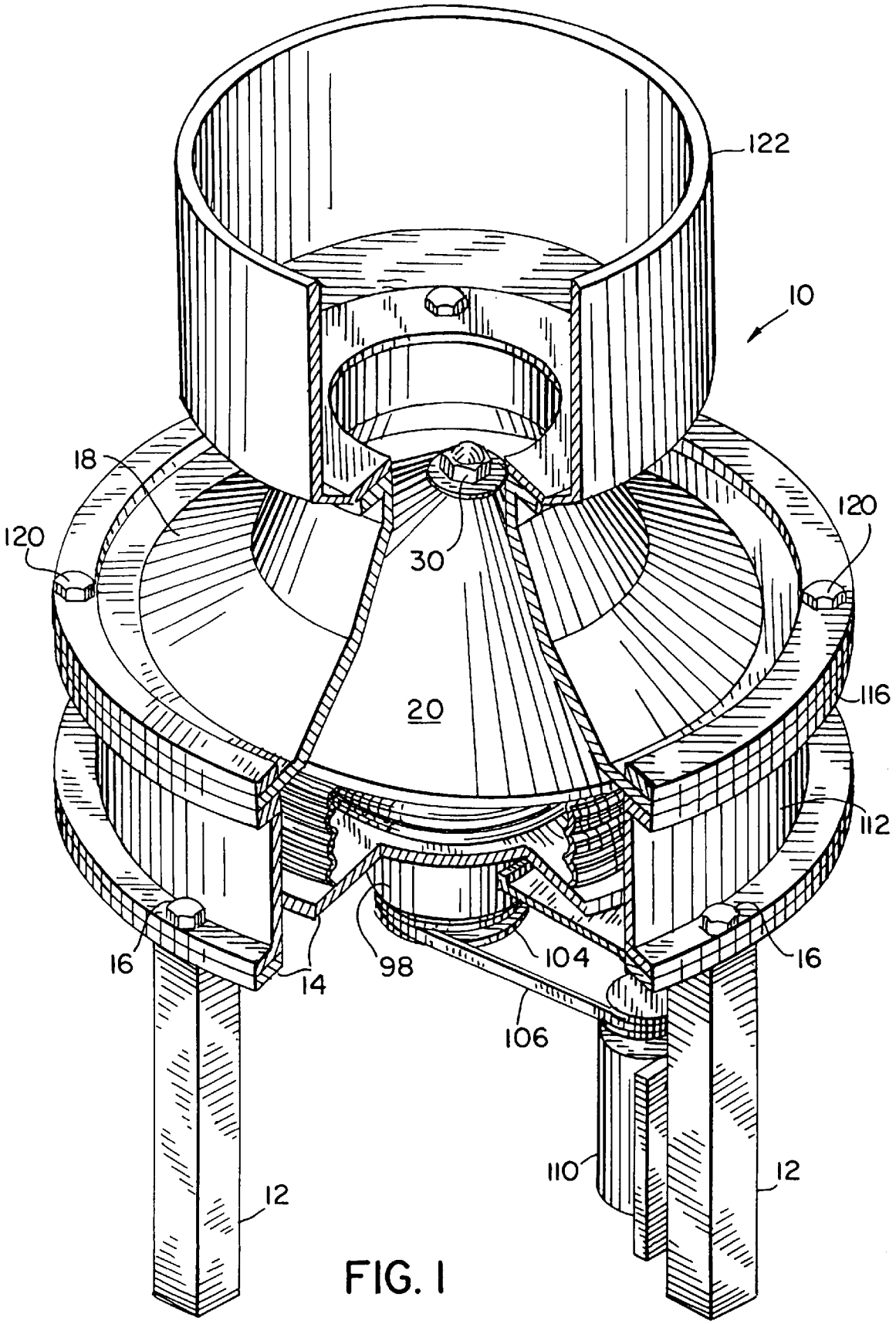
FIG. 1 is a perspective view of a conical crusher constructed in accordance with this invention.
Figures 2, 2A:
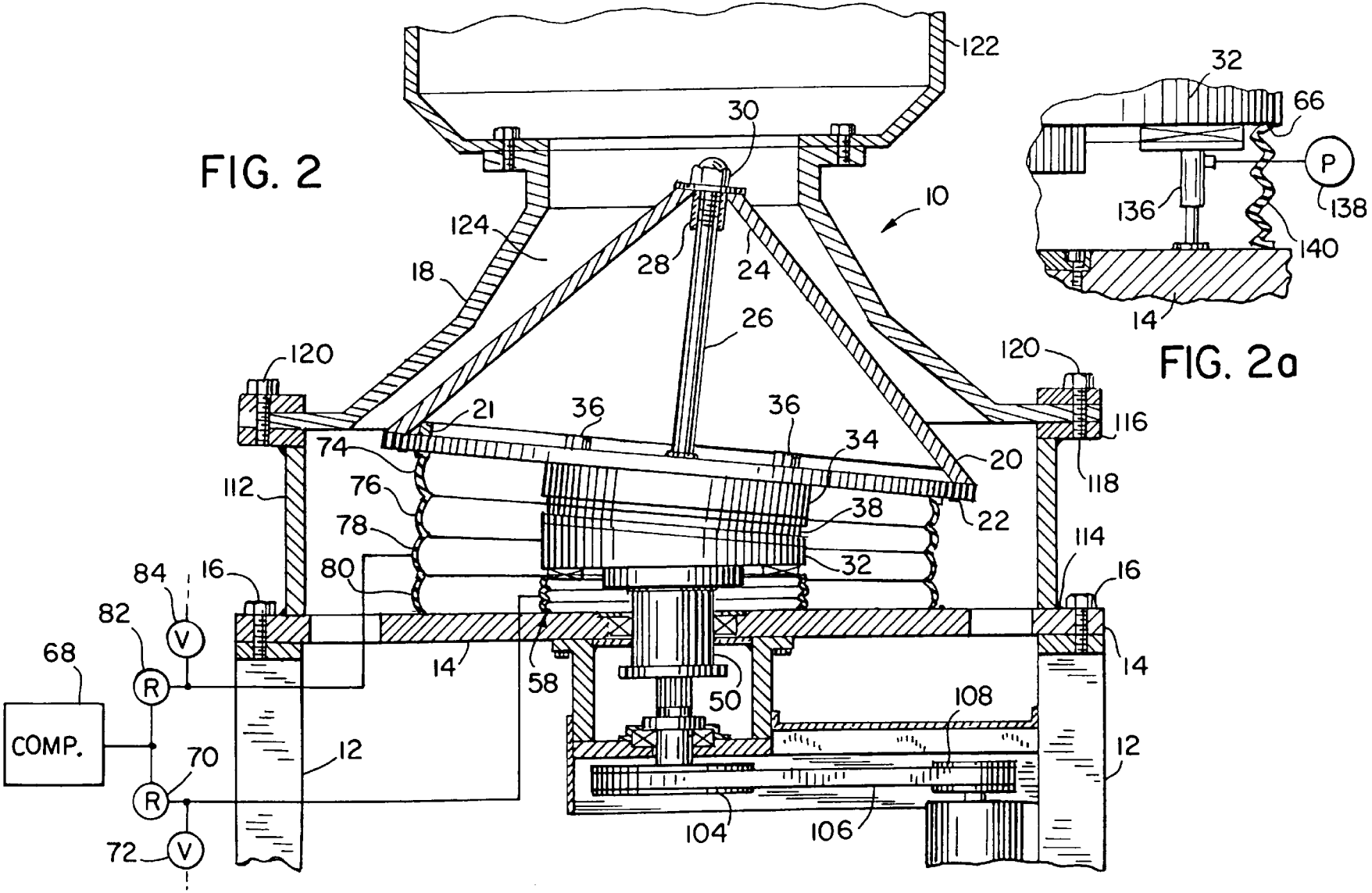
FIG. 2 is a cross-sectional view of the conical crusher of this invention as shown in FIG. 1.
FIG. 2*a* is a partial cross-sectional view of an alternate construction for a portion of the conical crusher as shown in FIG. 2.

Referring to FIGS. 1 and 2, a crushing system or conical crusher 10 in accordance with an exemplary embodiment of the present invention is shown supported on foundation pillars 12. The crusher is assembled on a main support member or bottom plate 14. The bottom plate 14 is secured to the foundation pillars 12 by anchoring means such as bolts 16. While the crusher is shown supported on pillars 12, it may be supported in any other suitable manner, such as on a cylindrical base having opening therein for removal of the crushed material and servicing of the crusher.

The crusher includes a frustoconically shaped downwardly spreading outer crushing member 18 and a conically shaped downwardly spreading inner crushing member 20. The inner crushing member 20, which is commonly referred to as a mantle, is supported along its lower edge on a bottom or a base plate 22. Base plate 22 can include a retaining member or retaining ring 21 to help secure member 20. A hole 24 is provided in the apex of the inner crushing member 20 through which passes a securing device 26 in the form of a rod which is secured at its lower end to the base plate 22 and is provided with a threaded portion 28 at its upper end. A fastener 30, in the form of a nut, engages the threaded portion 28 and presses on the top edge of the crushing member 20 to secure it to the base plate 22. Fastener 30 can be protected by a suitable wearing member disposed over it.

Figure 3:
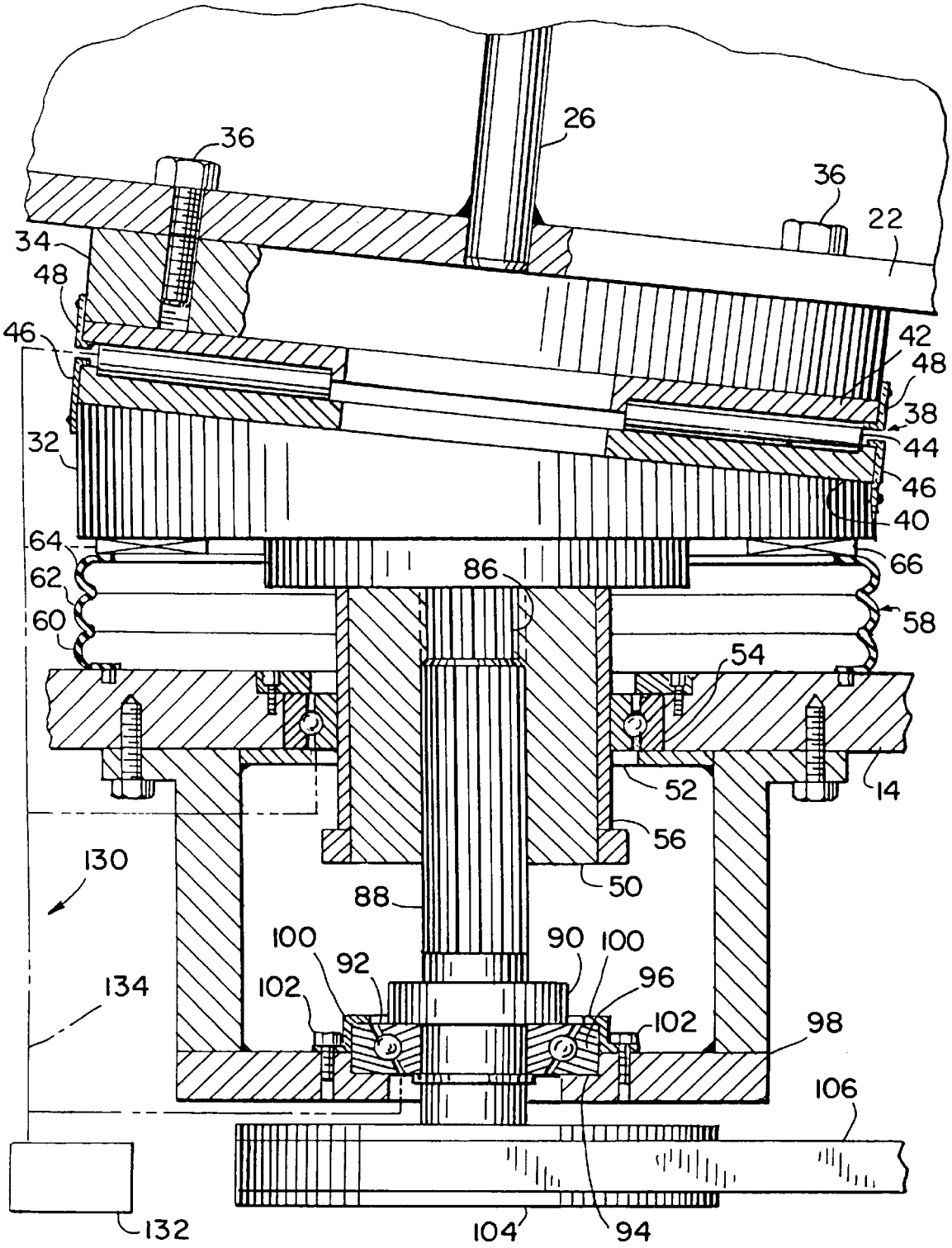
FIG. 3 is an enlarged cross-sectional view of the support and drive mechanism for the inner crushing member of the conical crusher of this invention as shown in FIG. 1.

Referring to FIGS. 2 and 3, the conically shaped inner crushing member 20 is supported on a wobble mechanism which includes a lower cylindrical member 32 and an upper cylindrical member 34. The upper cylindrical member 34 is secured to the base plate 22 by a fastener such as bolts 36. A bearing arrangement 38, shown as radially extending roller bearings, is interposed between the upper surface of lower member 32 and the lower surface of upper member 34 to permit the upper and lower member to rotate with respect to each other. Alternatively, bearing arrangement 38 can be a plurality of vertically disposed rollers located at an outer edge of members 32 and 34. Further still, bearing arrangement 38 can be a vertically disposed sleeve bearing systems or a horizontally disposed thrust bearing system.

As shown in FIG. 3, the bearing assembly 38 includes a lower bearing race 40, an upper bearing race 42, and rollers 44. The lower bearing race 40 is secured to lower member 32 by clamps 46, and the upper bearing race 42 is secured to upper member 34 by clamps 48. The lower member 32 is secured to and supported on the upper end of a shaft 50 for rotation therewith. Generally, any mechanism can be used to rotate, gyrate, move or wobble inner crushing member 20 including but not limited to an eccentric mechanism (not shown). The upper surface of the lower member 32 is in a plane which is not perpendicular to the central axis of the shaft 50. Thus, as the shaft 50 rotates, the upper member 34, which is prevented from rotating, as will hereinafter be described, is caused to wobble as alternately a higher and a lower portion of the upper surface of the lower member 32 passes under a fixed location on the upper member 34. The upper surface of the lower member 32 may be located in a plane which is not perpendicular to the central axis of the shaft 50 by forming the lower member 32 as a wedge shaped member, or by welding a uniformly thick lower member 32 to the end of the shaft 50 which has been cut in a plane which is not perpendicular to its central axis.

The shaft 50 passes through an aperture 52 formed in the bottom plate 14 and is supported for rotation therein by a bearing 54. The shaft 50 is surrounded by a cylindrical sleeve 56 which slides vertically with respect to the inner race of the bearing 54. The sleeve 56, which is secured to shaft 50, is formed of a material which will reduce the sliding friction between the inner race of the bearing 54 and shaft 50. The shaft 50, lower member 32 and upper member 34 of the wobble mechanism, as well as the inner crushing member 20, are supported on the bottom plate 14 by a fluid bellow assembly such as air bellow assembly 58 which is illustrated as three ring shaped bellows stacked one on top of the other. The bellows 60, 62 and 64 are secured to each other, and the lower surface of the lower bellow 60 is secured to the bottom plate 14 by securing devices such as pins. A ring like bearing assembly 66 is interposed between the top surface of the bellow 64 and the lower surface of the lower member 32. While not shown in detail, ring-like bearing assembly 66 could be similar in construction to bearing 38, with an upper bearing race secured to the lower surface of lower member 32, and a lower bearing race secured to the top of bellows 64. Bearing 66 can be a horizontally or vertically disposed sleeve bearing, roller bearing or thrust bearing.

The height of the lower member 32 with respect to the bottom plate 14 is adjusted by regulating the air pressure in the ring shaped bellows 60, 62 and 64. As shown in FIG. 2, air may be supplied from a compressor 68 through a regulator 70 to the bellows 60, 62 and 64. Should it be desirable to reduce the air pressure in bellows 60, 62, and 64, air may be discharged through valve 72.

The inner crushing member 20 is prevented from rotating by a fluid bellow assembly shown as a stack of air bellows 74, 76, 78 and 80. The bellows are secured to each other, and the upper surface of bellow 74 is secured to base plate 22 and the lower surface of lower bellow 80 is secured to the bottom plate 14. As in the case of the bellows 60, 62 and 64, a regulated supply of air is provided to the bellows 74, 76, 78 and 80 from air compressor 68 through a regulator 82. The regulated air pressure supplied to the bellows 74, 76, 78, and 80 is such that it permits wobbling of the base plate 22, and does not tend to lift the base plate 22, such that it would not be fully supported by the bellows 60, 62 and 64. Should it be desirable to reduce the air pressure in bellows 74, 76, 78, and 80, air may be discharged through valve 84. Not only do the bellows 74, 76, 78, and 80 prevent the inner crushing member 20 from turning, but they also provide a seal to prevent crushed material, and dust therefrom, from reaching the bearings 38 and 66. Similarly, bellows assembly 58 further prevents the crushed material and dust from reaching the upper surface of bearing 54.

The shaft 50 is provided with a splinted bore 86 which receives an externally splined shaft 88. The shaft 88 is held in a fixed vertical position by an increased diameter portion 90, the lower edge of which rests on the inner race 92 of a bearing assembly 94. Outer race 96, of the bearing assembly 94, is secured to a support bracket 98 by clamps 100 and fasteners 102. Attached to the lower end of the shaft 88 is a pulley 104. The pulley 104 is driven by a belt 106 which engages a pulley 108 driven by a prime mover 110, such as an electric motor. While a pulley and belt drive system is shown, other types of drive systems could be used, such as a hydraulic drive or a conventional gear and pinion shaft drive. Bearing assembly 94 can also be a horizontally or vertically disposed roller, sleeve or thrust bearing system.

The outer crushing member 18 is supported from the bottom plate 14 by a cylindrical wall member 112 which is welded at its lower end 114 to the bottom plate 14 and is provided with a flange 116 at the top. The flange 116 is provided with apertures 118 therein, located to coincide with apertures formed in the upper crushing member 18, to receive bolts such as 120 to secure the upper crushing member 18 to the cylindrical wall 112.

Turning to the operation of the crusher, material to be crushed is deposited in a hopper 122 through which it enters into a conical gap 124 between the outer crushing member 18 and the inner crushing member 20. As the inner crushing member 20 wobbles within the outer crushing member 18, the material falls in the area where the crushing members are more widely spaced and is thereafter crushed as the inner and outer members move together. By increasing the air pressure in bellows 60, 62, and 64, the inner crushing member 20 may be raised, moving its outer surface closer to the outer crushing member 18, thereby resulting in finer crushing of the material being crushed.

While in heavier duty crushers such as those set forth in the above-mentioned patents, replaceable wear members, usually called liners, are provided on the inner and outer crushing parts, in the conical crusher of this invention, the replaceable wear liners are not provided. However, members 18 and 20 can be replaced when worn. Rather, the inner crushing member or mantle and the outer or upper crushing member are formed of a suitable wear resistant material. Suitable materials for particular applications are manganese, air quenched and tempered chromium steel, and a low cost steel with wear resistant studs provided on the crushing surface. While the inner crushing member or mantle 20 and the outer crushing member 18 may be made of suitable wear resistant material, their strength may not be sufficient to prevent deformation in certain applications. To prevent deformation, the outer crushing member 18 may be provided with ribs. Or, a separate rib cage including ribs 126 (shown in FIG. 4) may be provided and can be secured over the outer crushing member 18. Similarly, a rib cage 128, as shown in FIG. 5, may be provided to fit under the mantle or inner crushing member 20 so as to reinforce it.

System parameters and design criteria can affect the size and shape of outer crushing member 18. Outer crushing member 18 preferably has generally parallel interior and exterior surfaces. The exterior surface of member 18 advantageously serves as an exterior housing surface for crusher 10. Member 18 can have various steps, angled surfaces or other formations and still be considered generally conical and to have generally parallel surfaces.

Referring to FIG. 2*a*, in an alternate embodiment of this invention the air bellow assembly 58 supporting the inner crushing member 20 on the bottom plate 14 is replaced by several hydraulic cylinders, one of which 136 is shown. Hydraulic pressure is supplied to the cylinders by a pump 138. To provide the bearing 54 with the same protection from crushed material and dust as is provided by the bellows 58, a flexible cylindrical wall 140 is secured to the bottom surface of lower cylindrical member 32 and bottom plate 14.

Bellow assembly 58 and air bellows 74, 76, 78, and 80 can be replaced by other support devices. System parameters and design criteria can affect the embodiment of either support device. For example, the support device between base plate 22 and bottom plate 14 preferably provides sufficient force to counteract crushing forces and yet does not substantially lift plate 22 with respect to plate 14. The support device allows wobbling of inner crushing member 20 and yet prevents inner crushing member 20 from turning. The support device preferably also seals bearing 38 from the crushed material in crusher 10. The support device can be a spring assembly, a cable tension assembly, a piston assembly, or other apparatus for providing an appropriate level of tension and force between member 20 and bottom plate 14.

To prolong the life of the bearings 38, 54, 66, and 94, a lubrication system 130 is provided whereby lubrication may be supplied to the bearings while the crusher is in operation. The lubrication system includes a pressurized source of lubricant 132, and a piping system 134 connecting each of the bearings to the source 132.

When comparing a conical crusher constructed in accordance with this invention as set forth above, with those shown in the prior art patents set forth above, it will be noted that the following advantages are offered:

1. Fewer parts.
2. Simplified manufacturing and fabrication.
3. Lower cost.
4. Increase energy efficiency.
5. Will operate with the material to be crushed being either wet or dry.
6. Lower operating cost per ton of product crushed.
7. Better quality control of the ground product through the ready adjustment provided by the bellows support system for the inner crushing member.
8. Ease of operation, maintenance and repair.

For instance, while replaceable liners are not provided, worn inner and outer crushing members can be readily replaced wherein they are attached to the crusher by readily engageable and disengageable fastening means shown as nuts and bolts.

It should be noted that if tramp material becomes wedged between the inner and outer grinding members, the air pressure in the bellows supporting the inner grinding member may be reduced, thereby permitting the inner grinding member to drop away from the outer grinding member so as to free the tramp material from between the grinding surfaces. Since the crushing gap between the inner and outer members is readily adjusted and controlled by the bellows support system, the particle size of the crushed material may be readily adjusted.

While one embodiment, and component variations of the invention have been shown, it should be apparent to those skilled in the art that what has been described is considered at present to be a preferred embodiment of the conical crusher of this invention. In accordance with the Patent Statute, changes may be made in the conical crusher without actually departing from the true spirit and scope of this invention. The appended claims are intended to cover all such changes and modifications which fall in the true spirit and scope of this invention.

What is claimed is:

1. A crusher comprising:

a hopper;

a main support member having at least one aperture therein, said aperture being defined by an annular rim;

a wobble mechanism disposed within said aperture;

a generally conically shaped downwardly spreading, inner crushing member supported by said main support member and coupled to said wobble mechanism for eccentric movement said inner crushing member being circumscribed by said main support member; and a one piece generally frustoconically shaped, downwardly spreading, outer crushing member supported on said annular rim of said main support member in a spaced relationship to said conically shaped inner crushing member such that material passing between said inner crushing member and said outer crushing member is crushed, the outer crushing member including a first flange for interfacing with the annular ring and a second flange for interfacing with said hopper.

2. The crusher of claim 1, wherein said one piece outer crushing member is secured to said main support member by engageable and disengageable fasteners, the main support member being generally cylindrical.

3. The crusher of claim 2, wherein said engageable and disengageable fasteners comprise nuts and bolts, with said bolts being received in apertures provided in said one piece outer crushing member and in said annular rim.

4. The crusher of claim 1, wherein said one piece outer crushing member is formed of manganese.

5. The crusher of claim 1, wherein said one piece outer crushing member is formed of air quenched and tempered chromium steel.

6. The crusher of claim 1, wherein said one piece outer crusher member is formed of a wear resistant composite or a deposited material.

7. The crusher of claim 6, wherein said wear resistant composite material is ceramic.

8. The crusher of claim 1, wherein a conically shaped, downwardly spreading rib cage is placed over said one piece, frustoconically shaped, downwardly spreading, outer crushing member, with said rib cage and said outer crushing member both being supported on said main support member.

9. The crusher of claim 8, wherein said one piece outer crushing member and said rib cage have lower peripheral edges supported from said main support member.

10. The crusher of claim 8, wherein said one piece outer crushing member and said rib cage are secured to said annular rim by engageable and disengageable fasteners.

11. The crusher of claim 10, wherein said engageable and disengageable fasteners comprise nuts and bolts, with said bolts being received in apertures provided in said one piece outer crusher member, said rib cage, and in said annular rim.

12. A single piece outer crushing member for use in a crusher including a feed hopper, a main support member and a generally conically shaped, downwardly spreading, inner crushing member supported by the main support member, the main support member including an outer rim, the inner crushing member being configured for gyrating with respect to the main support member, whereby material is fed through the feed hopper and is crushed between the outer crushing member and the inner crushing member, the single piece outer crushing member comprising:

a generally frustoconically shaped, downwardly spreading, crushing wall, the wall having a top end, an exterior surface, an interior surface and a bottom end, the exterior surface being an outside surface of the crusher, the interior surface being a crushing surface directly contacting the material during crushing;

a first flange integrally formed at said top end of said wall, said first flange being configured for engagement with the feed hopper; and a second flange integrally formed at said bottom end of said wall, said second flange being configured for engagement with the outer rim of the main support member.

13. The crushing member of claim 12, wherein said first flange has a plurality of first apertures configured to match a plurality of second apertures in the feed hopper.

14. The crushing member of claim 13, wherein said second flange has a plurality of third apertures configured to match a plurality of fourth apertures in the outer rim of the support member.

15. The crushing member of claim 14, wherein a plurality of bolts are disposed through said first, second, third and fourth apertures.

16. The crushing member of claim 12, wherein said one piece outer crushing member is formed of manganese and includes a clad material.

17. A crusher mounted on a foundation, said crusher comprising:

a main support member secured to the foundation, said main support member having at least one aperture therein;

a wobble mechanism disposed within said one aperture;

a conically shaped, downwardly spreading, inner crushing member coupled to said wobble mechanism and supported by said main support member; and a single piece frustoconically shaped, outer crushing member supported on said main support member in a spaced relationship to said conically shaped inner crushing member, said outer crushing member having an inside surface and an outside surface, said outside surface being an exterior surface of said crusher, said inside surface being a crushing surface directly contacting material being crushed.

18. The crusher of claim 17, further comprising a support cage disposed over said outer crushing member and attached to said main frame.

19. A crusher comprising:

a main support member having at least one aperture therein, said aperture being defined by an annular rim;

a generally conically shaped downwardly spreading, inner crushing member supported by said main support member;

a one piece generally frustoconically shaped, downwardly spreading, outer crushing member supported on said annular rim of said main support member in a spaced relationship to said conically shaped inner crushing member such that material passing between said inner crushing member and said outer crushing member is crushed; and a conically shaped, downwardly spreading rib cage disposed over said one piece, frustoconically shaped, downwardly spreading, outer crushing member, with said rib cage and said outer crusher member both being supported on said main support member.

20. A crusher comprising:

a main support member having at least one aperture therein;

a wobble mechanism disposed within said one aperture;

a conically shaped, downwardly spreading, inner crushing member coupled to said wobble mechanism and supported by said main support member;

a single piece frustoconically shaped, outer crushing member supported on said main support member in a spaced relationship to said conically shaped inner crushing member, said outer crushing member having an inside surface and an outside surface, said outside surface being an exterior surface of said crusher; and a support cage disposed over said outer crushing member and attached to said main frame.

* * * * *